US012011057B2

(12) United States Patent
Hort et al.

(10) Patent No.: US 12,011,057 B2
(45) Date of Patent: Jun. 18, 2024

(54) SAFETY HELMET

(71) Applicant: MSA Technology, LLC, Cranberry Township, PA (US)

(72) Inventors: Celeste L. Hort, Cranberry Township, PA (US); Michael Goodspeed, Pittsburgh, PA (US); Kevin R. Ketterer, Portersville, PA (US); Jefferson S. Mendenhall, Volant, PA (US); Matthew C. Miller, Pittsburgh, PA (US); James R. Tomlinson, Pittsburgh, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 100 days.

(21) Appl. No.: 17/146,711

(22) Filed: Jan. 12, 2021

(65) Prior Publication Data

US 2021/0212406 A1 Jul. 15, 2021

Related U.S. Application Data

(60) Provisional application No. 62/960,415, filed on Jan. 13, 2020.

(51) Int. Cl.

| | |
|---|---|
| ***A42B 3/22*** | (2006.01) |
| ***A42B 3/28*** | (2006.01) |
| ***A42C 2/00*** | (2006.01) |

(52) U.S. Cl.

CPC ..... *A42B 3/285* (2013.01); *A42C 2/00* (2013.01)

(58) Field of Classification Search

CPC ..... A42B 3/285; A42B 3/10; A42B 3/061; A42B 3/06; A42B 1/009; A42C 2/00

See application file for complete search history.

(56) References Cited

U.S. PATENT DOCUMENTS 4,425,917 A * 1/1984 Kuznetz ..... F25D 3/08 607/110
4,619,003 A * 10/1986 Asbury ..... A42C 5/04 2/5
5,360,230 A 11/1994 Yamada et al.
(Continued)

FOREIGN PATENT DOCUMENTS

CN 106038048 A * 10/2016
EP 1940299 B1 4/2010
(Continued)

OTHER PUBLICATIONS

European Patent Office, Appl. 21740695.8; Extended European Search Report, Jan. 5, 2024.

*Primary Examiner* — Heather Mangine
*Assistant Examiner* — Erick I Lopez
(74) *Attorney, Agent, or Firm* — Jones Day

(57) ABSTRACT

A safety helmet includes an outer shell configured for surrounding a head of a user, and an infrared reflective layer disposed in an interior of the outer shell. The infrared reflective layer is configured for reflecting at a least a portion of incident infrared radiation transmitted through the outer shell. The infrared reflective layer has infrared reflectivity of at least 40%. The safety helmet further may have an evaporative cooling pad positioned within a cavity defined by the inner surface of the outer shell. A method of manufacturing a safety helmet is also disclosed.

22 Claims, 7 Drawing Sheets

(56) References Cited

U.S. PATENT DOCUMENTS 5,557,807 A * 9/1996 Hujar ..... A42B 1/0187 2/209.13
5,630,230 A * 5/1997 Fujino ..... A42B 3/10 2/200.1
5,653,222 A * 8/1997 Newman ..... F24S 80/50 126/708
6,178,560 B1 * 1/2001 Halstead ..... A42B 3/122 2/413
6,464,672 B1 10/2002 Buckley
6,481,021 B2 11/2002 Spell
6,792,624 B2 9/2004 Simmons
6,904,617 B2 6/2005 Tsai
7,028,344 B2 4/2006 Toth
7,048,976 B2 5/2006 Caceres et al.
7,681,253 B2 3/2010 Kobayashi
7,866,177 B2 1/2011 Selm et al.
8,021,406 B2 9/2011 Cazzini et al.
8,117,677 B2 2/2012 Toth
8,381,319 B2 2/2013 Stein
8,628,561 B2 1/2014 Ishizaki
8,696,726 B2 4/2014 Barbknecht
9,188,398 B2 11/2015 Freeman et al.
9,241,522 B2 1/2016 Branson
9,271,530 B2 3/2016 Kobayshi
9,433,246 B2 9/2016 Freeman et al.
9,668,529 B2 6/2017 Branson
10,021,926 B2 7/2018 Stevenson
10,111,482 B2 10/2018 Brandt et al.
10,314,351 B2 6/2019 Stevenson
10,472,480 B2 11/2019 Kliesch et al.
10,513,616 B2 12/2019 Jin et al.
10,619,068 B2 4/2020 Mitsumoto et al.
10,633,869 B2 4/2020 Hieke et al.
10,648,751 B1 5/2020 Surowka
10,722,917 B2 7/2020 Fujita et al.
10,816,703 B2 10/2020 Decoux
10,844,230 B2 11/2020 Babilo et al.
10,882,997 B2 1/2021 Disteldorf et al.
11,059,979 B2 7/2021 Pan et al.
11,118,068 B2 9/2021 McQuown et al.
11,118,070 B2 9/2021 Lofftus
11,124,658 B2 9/2021 Fujita et al.
11,129,429 B2 9/2021 Hinds et al.
11,163,132 B2 11/2021 Kubota et al.
2002/0069448 A1 6/2002 Appolonia
2002/0197924 A1 12/2002 Halley et al.
2003/0208831 A1 11/2003 Lazar et al.
2004/0128747 A1 7/2004 Bumbarger et al.
2004/0244095 A1 12/2004 Sonne et al.
2005/0034215 A1 2/2005 Harrison et al.
2005/0118383 A1 6/2005 Cargill et al.
2006/0026742 A1 * 2/2006 Lang-Ree ..... A42B 3/10 2/412
2006/0195296 A1 * 8/2006 Petrich ..... G16H 10/40 702/183
2007/0162096 A1 7/2007 Zakuto et al.
2007/0225782 A1 9/2007 Taylor
2007/0275238 A1 11/2007 Moretti et al.
2008/0040839 A1 2/2008 Gordon
2008/0141434 A1 6/2008 Pringles et al.
2008/0147151 A1 6/2008 Rivera
2008/0276340 A1 11/2008 Wiles
2009/0203275 A1 8/2009 Dehn
2009/0264969 A1 10/2009 Gammons
2010/0011489 A1 1/2010 Goldmann et al.
2010/0108287 A1 5/2010 Ota et al.
2010/0132092 A1 6/2010 Temblador
2010/0137953 A1 6/2010 Stein
2011/0195243 A1 8/2011 Polegato Moretti et al.
2012/0190259 A1 7/2012 Frost
2012/0207874 A1 8/2012 Middleton et al.
2012/0210490 A1 * 8/2012 Harty ..... A42B 3/121 2/171.2
2013/0118199 A1 5/2013 Stein
2013/0296986 A1 11/2013 Dukes
2013/0337393 A1 * 12/2013 Henn ..... F24B 1/192 427/314
2014/0011025 A1 * 1/2014 Ishiba ..... C09J 7/385 428/355 AC
2014/0087104 A1 3/2014 Kierderle et al.
2014/0137596 A1 5/2014 Dijkema et al.
2014/0318154 A1 * 10/2014 Kobayashi ..... F25D 7/00 62/3.5
2014/0358205 A1 12/2014 Robke et al.
2015/0082521 A1 * 3/2015 Hassan ..... A42B 3/061 2/424
2015/0342279 A1 12/2015 Haggard et al.
2016/0120257 A1 5/2016 McCoy
2016/0199220 A1 7/2016 Daisaku
2016/0228290 A1 8/2016 Davidson
2016/0331059 A1 * 11/2016 Basson ..... A42B 3/222
2016/0374419 A1 12/2016 Hunley
2017/0127744 A1 5/2017 Haggard et al.
2017/0231814 A1 8/2017 Collins
2017/0304112 A1 10/2017 Burstein et al.
2018/0103712 A1 4/2018 Krishnan
2018/0323320 A1 * 11/2018 Mehrl ..... G02B 19/0076
2019/0021432 A1 1/2019 Krishnan
2019/0029350 A1 1/2019 Brandt et al.
2019/0350399 A1 11/2019 Abayasinghe et al.
2019/0357602 A1 11/2019 Abati
2020/0216679 A1 7/2020 Fang et al.
2020/0291241 A1 9/2020 Foley et al.
2021/0071010 A1 3/2021 Greenwood et al.
2021/0112895 A1 4/2021 Beckham et al.
2021/0123558 A1 4/2021 Leroy et al.
2021/0130623 A1 5/2021 Skorina et al.
2021/0163759 A1 6/2021 Zalich et al.
2021/0171731 A1 6/2021 Mandal et al.
2021/0212406 A1 7/2021 Hort et al.
2021/0214886 A1 7/2021 Hussey et al.
2021/0218148 A1 7/2021 Banerjee et al.
2021/0237119 A1 8/2021 Gontani et al.
2021/0253863 A1 8/2021 Zieba et al.
2021/0253876 A1 8/2021 Zalich et al.
2021/0321702 A1 10/2021 Conolly et al.
2021/0324212 A1 10/2021 Yamanaka et al.
2021/0355261 A1 11/2021 Pearson et al.

FOREIGN PATENT DOCUMENTS

EP 1711144 B1 8/2011
EP 2380534 A1 10/2011
EP 2560591 B1 5/2014
EP 2820965 A1 1/2015
EP 2150219 B1 8/2016
EP 1701629 B2 9/2016
EP 2561298 B1 9/2017
EP 3326478 A1 5/2018
EP 3326478 A1 * 5/2018 ..... A43B 1/04
EP 2667739 B1 8/2018
EP 3229625 B1 8/2019
EP 3126460 B1 1/2020
EP 2635643 B1 2/2020
EP 3039086 B1 3/2020
EP 2710201 B1 4/2020
EP 3689977 A1 8/2020
EP 3726592 A1 10/2020
EP 3502201 B1 3/2021
EP 3257903 B1 4/2021
EP 3475077 B1 7/2021
EP 2121201 B1 8/2021
EP 3416511 B1 3/2022
JP 2011256505 A * 12/2011 ..... A42B 3/285
JP 2017179659 A 10/2017
JP 2017179659 A * 10/2017
WO 2009015901 A1 2/2009
WO 2010011614 A3 1/2010
WO 2012008840 A2 1/2012
WO 2017106883 A1 6/2017
WO WO-2017106883 A1 * 6/2017
WO 2019016616 A1 1/2019

(56) References Cited

FOREIGN PATENT DOCUMENTS

| | | | |
|---|---|---|---|
| WO | 2019079316 | A1 | 4/2019 |
| WO | 2020072818 | A1 | 4/2020 |
| WO | 2020131841 | A1 | 6/2020 |
| WO | 2020150322 | A1 | 7/2020 |
| WO | 2020150821 | A1 | 7/2020 |
| WO | 2021008981 | A1 | 1/2021 |
| WO | 2021059187 | A1 | 4/2021 |
| WO | 2021149088 | A1 | 7/2021 |
| WO | 2021198120 | A1 | 10/2021 |
| WO | 2021198121 | A1 | 10/2021 |
| WO | 2021201566 | A1 | 10/2021 |
| WO | 2021206062 | A1 | 10/2021 |

* cited by examiner

SAFETY HELMET

CROSS-REFERENCE TO RELATED APPLICATION

The present application claims priority to U.S. Provisional Application No. 62/960,415, entitled "Safety Helmet" and filed on Jan. 13, 2020, the disclosure of which is incorporated by reference herein in its entirety.

BACKGROUND

Technical Field

The present disclosure relates generally to safety helmets for use in various situations and environments, and in particular to a safety helmet having a thermal management assembly configured for reducing a temperature of a user's head while wearing the safety helmet.

Technical Description

Safety helmets are widely used in a variety of environments. A safety helmet typically includes a hard outer shell for protecting the head of the user. The outer shell is generally made from a thermoplastic material. Typically, the thermoplastic material is configured to transmit at least a portion of infrared radiation emitted from the sun. When such a safety helmet is worn in warm ambient conditions with direct exposure to the sun, the interior of the outer shell is typically warmer than the ambient temperature due to the transmittance of infrared radiation through the material of the outer shell. This increased temperature of the interior of the safety helmet contributes to an increase in the temperature of the user's head, thereby making it uncomfortable for the user to wear the safety helmet in warm/hot weather.

Accordingly, in view of these and other disadvantages of existing safety helmets, there is a need in the art for an improved safety helmet that can be easily and effectively worn by the user in a variety of environments while improving user comfort by reducing a temperature of the user's head when the safety helmet is worn in warm/hot ambient conditions.

SUMMARY

Generally, the present disclosure provides an improved safety helmet that addresses and/or overcomes some or all of the drawbacks associated with existing safety helmets. In some non-limiting embodiments or aspects, provided is a safety helmet that may have an outer shell configured for surrounding a head of a user, and an infrared reflective layer disposed in an interior of the outer shell. The infrared reflective layer may be configured for reflecting at a least a portion of incident infrared radiation transmitted through the outer shell. The infrared reflective layer may have infrared reflectivity of at least 40%.

In accordance with some non-limiting embodiments or aspects, the infrared reflective layer may have infrared reflectivity in a range of 83% to 89%. The infrared reflective layer may have a hemispherical emissivity of less than 0.2. The infrared reflective layer has an optical density of at least 2.0. The infrared reflective layer may have a thickness of 20 nm to 5 μm.

In accordance with some non-limiting embodiments or aspects, the infrared reflective layer may have at least one of the following: aluminum, gold, silver, copper, and any combination thereof. The infrared reflective layer may have at least one of the following: doped titanium dioxide, doped or undoped indium tin oxide, doped cerium oxide, doped manganese oxide, iron (III) oxide, cadmium sulfide, chromium trioxide, and any combination thereof.

In accordance with some non-limiting embodiments or aspects, the infrared reflective layer is applied on an insert that is removably or non-removably connected to the outer shell. The insert may include a substrate made from a thermoplastic film.

In accordance with some non-limiting embodiments or aspects, a safety helmet may include an outer shell configured for surrounding a head of a user, and an infrared reflective layer on at least a portion of the an inner surface of the outer shell. The infrared reflective layer may be configured for reflecting at a least a portion of incident infrared radiation transmitted through the outer shell. The helmet further may include an evaporative cooling pad positioned within a cavity defined by the inner surface of the outer shell. The evaporative cooling pad may include a top waterproof, vapor permeable layer and a bottom waterproof, vapor permeable layer with a cavity defined therebetween. An outside surface of the bottom layer may be configured to be in contact with the head of the user. The evaporative cooling pad further may include a liquid absorbing layer positioned within the cavity.

In accordance with some non-limiting embodiments or aspects, the top and bottom layers may include a nylon material laminated with a waterproof and vapor permeable material. At least one of the top and bottom layers may include polyurethane or polytetrafluoroethylene.

In accordance with some non-limiting embodiments or aspects, the evaporative cooling pad further may include a sweat absorbing fabric on an outside surface of the bottom layer. The evaporative cooling pad further may include an opening in at least one of the top and bottom layers, and wherein the opening has a zipper. The evaporative cooling pad further may include a main portion having a first end and a second end, and a pair of wings extending laterally from the first end. The first end may be configured to be in contact with a forehead of the user. Each of the pair of wings may be configured to extend to a temple of the user. The second end may be configured to extend to a top of the head of the user.

In accordance with some non-limiting embodiments or aspects, a method of manufacturing a safety helmet may include molding an outer shell of the safety helmet out of a thermoplastic material; and applying an infrared reflective layer onto at least a portion of an inner surface of the outer shell or applying the infrared reflective layer onto an insert that is connectable to the outer shell.

In accordance with some non-limiting embodiments or aspects, the insert having the infrared reflective layer may be integrally formed with the outer shell during molding of the outer shell. The method may further include connecting the insert having the infrared reflective layer to the outer shell by at least one of the following: adhesive, one or more mechanical clips or fasteners, press fit, ultrasonic bonding, and any combination thereof. The method may further include inserting an evaporative cooling pad inside a cavity of the outer shell defined by the inner surface. The evaporative cooling pad may include a top waterproof, vapor permeable layer and a bottom waterproof, vapor permeable layer with a cavity defined therebetween; a liquid absorbing layer positioned within the cavity; and an opening in at least one of the top and bottom layers.

In accordance with some non-limiting embodiments or aspects, the safety helmet may be characterized by one or more of the following clauses:

Clause 1: A safety helmet comprising: an outer shell configured for surrounding a head of a user; and an infrared reflective layer disposed in an interior of the outer shell, the infrared reflective layer being configured for reflecting at a least a portion of incident infrared radiation transmitted through the outer shell, wherein the infrared reflective layer has infrared reflectivity of at least 40%.

Clause 2: The safety helmet of clause 1, wherein the infrared reflective layer has infrared reflectivity in a range of 83% to 89%.

Clause 3: The safety helmet of clause 1 or 2, wherein the infrared reflective layer has a hemispherical emissivity of less than 0.2.

Clause 4: The safety helmet of any of clauses 1-3, wherein the infrared reflective layer has an optical density of at least 2.0.

Clause 5: The safety helmet of any of clauses 1-4, wherein the infrared reflective layer comprises at least one of the following: aluminum, gold, silver, copper, and any combination thereof.

Clause 6: The safety helmet of any of clauses 1-5, wherein the infrared reflective layer comprises at least one of the following: doped titanium dioxide, doped or undoped indium tin oxide, doped cerium oxide, doped manganese oxide, iron (III) oxide, cadmium sulfide, chromium trioxide, and any combination thereof.

Clause 7: The safety helmet of any of clauses 1-6, wherein a thickness of the infrared reflective layer is 20 nm to 5 μm.

Clause 8: The safety helmet of any of clauses 1-7, wherein the infrared reflective layer is applied on an insert that is removably or non-removably connected to the outer shell.

Clause 9: The safety helmet of any of clauses 1-8, wherein the insert comprises a substrate made from a thermoplastic film.

Clause 10: A safety helmet comprising: an outer shell configured for surrounding a head of a user; an infrared reflective layer on at least a portion of the an inner surface of the outer shell, the infrared reflective layer being configured for reflecting at a least a portion of incident infrared radiation transmitted through the outer shell; and an evaporative cooling pad positioned within a cavity defined by the inner surface of the outer shell, the evaporative cooling pad comprising: a top waterproof, vapor permeable layer and a bottom waterproof, vapor permeable layer with a cavity defined therebetween, wherein the outside surface of the bottom layer is configured to be in contact with the head of the user; and a liquid absorbing layer positioned within the cavity.

Clause 11: The safety helmet of clause 10, wherein the top and bottom layers comprise a nylon material laminated with a waterproof and vapor permeable material.

Clause 12: The safety helmet of clause 10 or 11, wherein at least one of the top and bottom layers comprises polyurethane or polytetrafluoroethylene.

Clause 13: The safety helmet of any of clauses 10-12, wherein the evaporative cooling pad further comprises a sweat absorbing fabric on an outside surface of the bottom layer.

Clause 14: The safety helmet of any of clauses 10-13, wherein the evaporative cooling pad further comprises an opening in at least one of the top and bottom layers, and wherein the opening has a zipper.

Clause 15: The safety helmet of any of clauses 10-14, wherein the evaporative cooling pad comprises a main portion having a first end and a second end, and a pair of wings extending laterally from the first end.

Clause 16: The safety helmet of any of clauses 10-15, wherein the first end is configured to be in contact with a forehead of the user, wherein each of the pair of wings is configured to extend to a temple of the user, and wherein the second end is configured to extend to a top of the head of the user.

Clause 17: A method of manufacturing a safety helmet comprising: molding an outer shell of the safety helmet out of a thermoplastic material; and applying an infrared reflective layer onto at least a portion of an inner surface of the outer shell or applying the infrared reflective layer onto an insert that is connectable to the outer shell.

Clause 18: The method of clause 17, wherein the insert having the infrared reflective layer is integrally formed with the outer shell during molding of the outer shell.

Clause 19: The method of clause 17 or 18, further comprising connecting the insert having the infrared reflective layer to the outer shell by at least one of the following: adhesive, one or more mechanical clips or fasteners, press fit, ultrasonic bonding, and any combination thereof.

Clause 20: The method of any of clauses 17-19, further comprising inserting an evaporative cooling pad inside a cavity of the outer shell defined by the inner surface, wherein the evaporative cooling pad comprises: a top waterproof, vapor permeable layer and a bottom waterproof, vapor permeable layer with a cavity defined therebetween; a liquid absorbing layer positioned within the cavity; and an opening in at least one of the top and bottom layers.

These and other features and characteristics of the present disclosure, as well as the methods of operation and functions of the related elements of structures and the combination of parts and economics of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. Hence, specific dimensions and other physical characteristics related to the embodiments disclosed herein are not to be considered as limiting. Further, it is to be understood that the disclosure may assume various alternative variations and step sequences, except where expressly specified to the contrary.

BRIEF DESCRIPTION OF THE DRAWINGS

In FIGS. 1-8, like characters refer to the same components and elements, as the case may be, unless otherwise stated.

DETAILED DESCRIPTION

Figure 1:
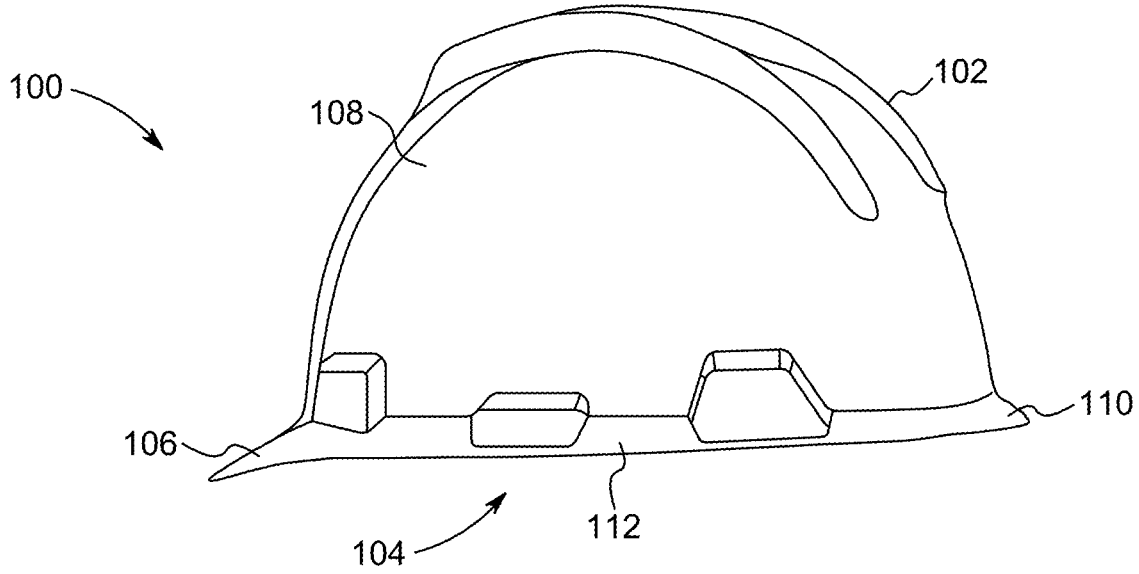
FIG. 1 is a side view of a safety helmet in accordance with some non-limiting embodiments or aspects of the present disclosure.

For purposes of the description hereinafter, the terms "end", "upper", "lower", "right". "left", "vertical", "horizontal", "top", "bottom", "lateral", "longitudinal" and derivatives thereof shall relate to the disclosure as it is oriented in the drawing figures. However, it is to be understood that the disclosure may assume various alternative variations and step sequences, except where expressly specified to the contrary.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, or C" includes one or more of A alone; or one or more B alone; or one or more of C alone; or one or more of A and one or more of B; or one or more of A and one or more of C; or one or more of B and one or more of C; or one or more of all of A, B, and C.

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

In the present document, the word "exemplary" is used herein to mean "serving as an example, instance, or illustration." Any embodiment or implementation of the present subject matter described herein as "exemplary" is not necessarily to be construed as preferred or advantageous over other embodiments or aspects.

The terms "comprises", "comprising", or any other variations thereof, are intended to cover a non-exclusive inclusion, such that a setup, device, or method that comprises a list of components or steps does not include only those components or steps but may include other components or steps not expressly listed or inherent to such setup, device, or method. In other words, one or more elements in a system or apparatus proceeded by "comprises . . . a" does not, without more constraints, preclude the existence of other elements or additional elements in the system or method.

The terms "includes", "including", or any other variations thereof are intended to cover a non-exclusive inclusion such that a setup, device, or method that includes a list of components or steps does not include only those components or steps but may include other components or steps not expressly listed or inherent to such setup, device, or method. In other words, one or more elements in a system or apparatus proceeded by "includes . . . a" does not, without more constraints, preclude the existence of other elements or additional elements in the system or method.

The terms "an embodiment", "embodiment", "embodiments", "the embodiment", "the embodiments", "one or more embodiments", "some non-limiting embodiments or aspects", and "one embodiment" mean "one or more (but not all) embodiments of the present disclosure" unless expressly specified otherwise. A description of an embodiment with several components in communication with each other does not imply that all such components are required. On the contrary, a variety of optional components is described to illustrate the wide variety of possible embodiments of the disclosure.

No aspect, component, element, structure, act, step, function, instruction, and/or the like used herein should be construed as critical or essential unless explicitly described as such. Also, as used herein, the articles "a" and "an" are intended to include one or more items and may be used interchangeably with "one or more" and "at least one." Furthermore, as used herein, the term "set" is intended to include one or more items (e.g., related items, unrelated items, a combination of related and unrelated items, and/or the like) and may be used interchangeably with "one or more" or "at least one." Where only one item is intended, the term "one" or similar language is used. Also, as used herein, the terms "has", "have", "having", or the like are intended to be open-ended terms. Further, the phrase "based on" is intended to mean "based at least in partially on" unless explicitly stated otherwise. The term "some non-limiting embodiments or aspects" means "one or more (but not all) embodiments or aspects of the disclosure(s)" unless expressly specified otherwise. A description of some non-limiting embodiments or aspects with several components in communication or combination with each other does not imply that all such components are required. On the contrary, a variety of optional components is described to illustrate the wide variety of possible embodiments of the disclosure.

When a single device or article is described herein, it will be clear that more than one device/article (whether they cooperate) may be used in place of a single device/article. Similarly, where more than one device or article is described herein (whether they cooperate), it will be clear that a single device/article may be used in place of the more than one device or article or a different number of devices/articles may be used instead of the shown number of devices or programs. The functionality and/or the features of a device may be alternatively embodied by one or more other devices which are not explicitly described as having such functionality/features. Thus, other embodiments or aspects of the disclosure need not include the device itself.

As discussed herein, certain operations may be performed in a different order, modified, or removed. Moreover, steps may be added to methods described herein and still conform to the described embodiments. Further, operations described herein may occur sequentially or certain operations may be processed in parallel.

In the following detailed description of the embodiments of the disclosure, reference is made to the accompanying drawings that form a part hereof, and in which are shown by way of illustration specific embodiments in which the disclosure may be practiced. It should be understood, however, that it is not intended to limit the disclosure to the forms disclosed, but on the contrary, the disclosure is to cover all modifications, equivalents, and alternatives falling within the spirit and the scope of the disclosure. It is to be understood that other embodiments may be utilized and that changes may be made without departing from the scope of the present disclosure. The following description is, therefore, not to be taken in a limiting sense.

Various embodiments or aspects of the present disclosure are directed to a safety helmet having a thermal management assembly configured for reducing a temperature of a user's head while wearing the safety helmet.

With reference to FIG. 1, provided is a safety helmet 100 (hereinafter referred to as "helmet 100") having a rigid outer shell 102 configured to surround the head of a user. The outer shell 102 has a generally hemi-spherical form and has a facial opening 104 at a front end configured to be situated above the user's face. The shell 102 includes a front portion 106 situated above the facial opening 104, an upper portion 108, and a rear portion 110 extending from the upper portion 108 to the nape of the user's neck. A pair of lateral portions 112 extend from the upper portion 108 on each side of the facial opening 104.

In some non-limiting embodiments or aspects, the outer shell 102 is made from a thermoplastic material, such as high density polyethylene (HDPE) or polycarbonate. The outer shell 102 may be made using, for example, an injection molding process. Some thermoplastic materials are at least partially transmissive to infrared radiation (IR) from the sun (see FIG. 3D). With such materials, IR is not absorbed or reflected by the outer shell 102. Instead, IR is transmitted through the material of the outer shell 102. As used herein, IR refers to solar infrared radiation in the range of 700-1500 nm.

Figure 3A:
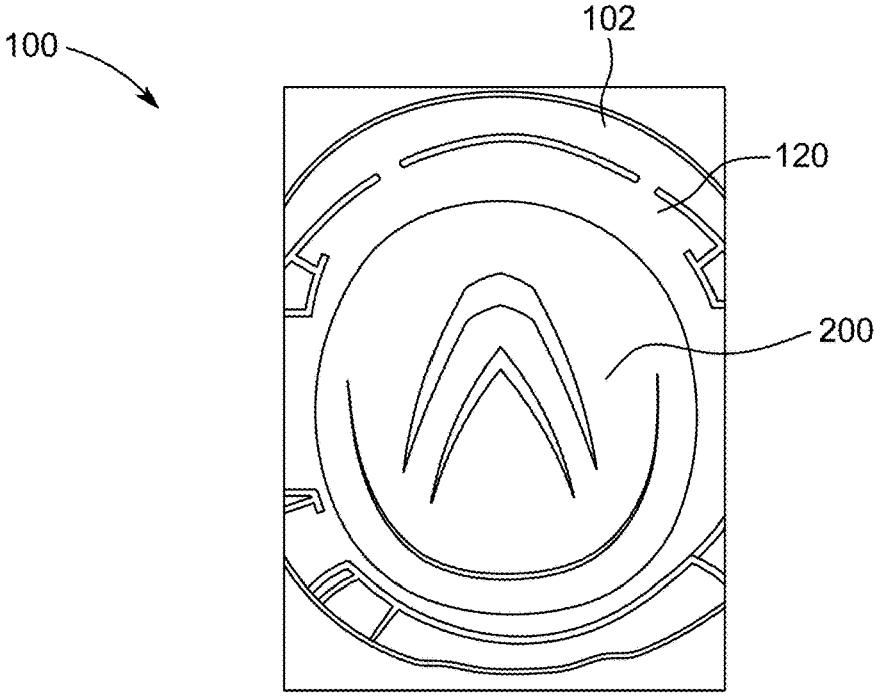
FIG. 3A is a bottom view of a safety helmet in accordance with some non-limiting embodiments or aspects of the present disclosure.
Figure 3B:
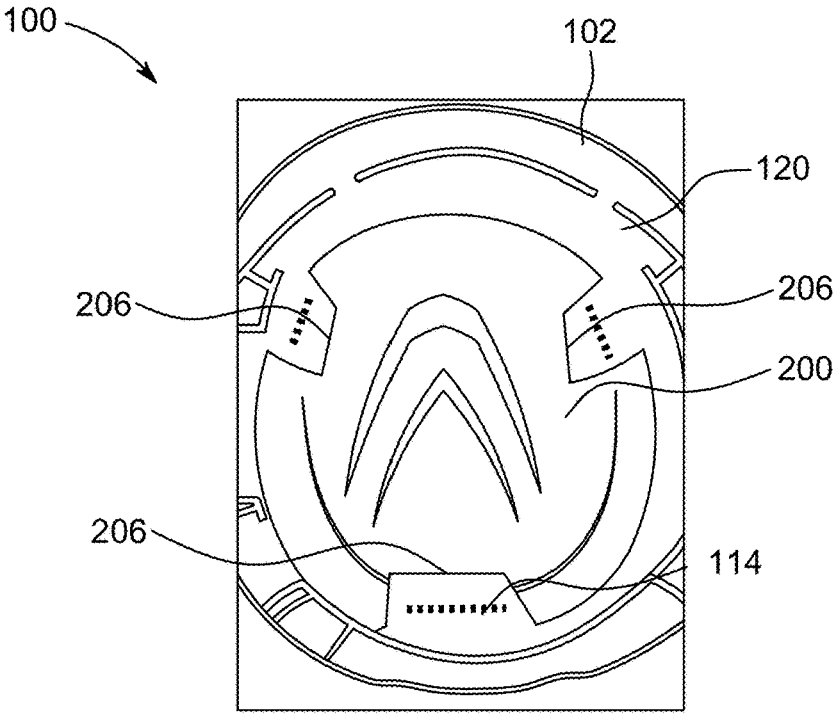
FIG. 3B is a bottom view of a safety helmet in accordance with some non-limiting embodiments or aspects of the present disclosure.

The helmet 100 may have an infrared reflective layer 200 configured for reflecting at least a portion of incident IR. For example, in order to prevent the inside of the outer shell 102 from becoming warmer due to transmittance of IR through the material of the outer shell 102, in some non-limiting embodiments or aspects, the infrared reflective layer 200 is provided on at least a portion of an inner surface 120 (shown in FIGS. 3A-3B) of the outer shell 102. For example, the infrared reflective layer 200 may be provided on up to 100% of the inner surface 120 of the outer shell 102. In some embodiments or aspects, one or more cutouts 206 may be formed on the infrared reflective layer 200 to correspond with one or more vent openings 114 on the outer shell 102 of the helmet 100.

Figure 3C:
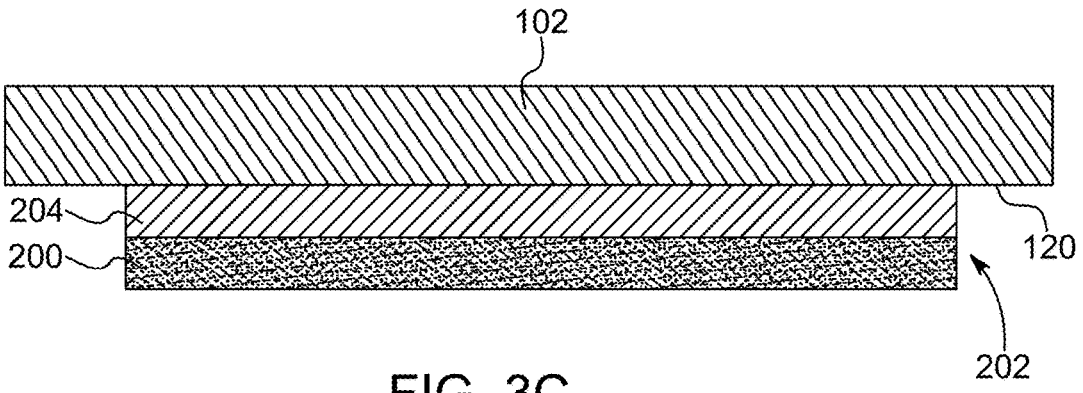
FIG. 3C is a cross-sectional view of an outer shell of a safety helmet having an infrared reflective layer in accordance with some non-limiting embodiments or aspects of the present disclosure.
Figure 3D:
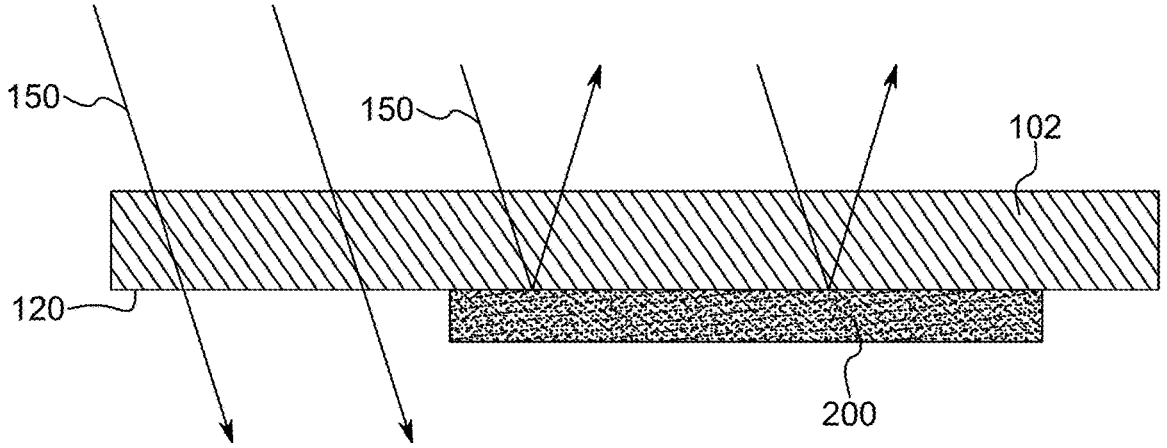
FIG. 3D is a cross-sectional view of an outer shell of a safety helmet having an infrared reflective layer showing infrared light reflecting properties in accordance with some non-limiting embodiments or aspects of the present disclosure.

The infrared reflective layer 200 is configured for reflecting at least a portion of incident IR 150 into the thermoplastic material of the outer shell 102 and away from the user's head (see FIG. 3D). By placing the infrared reflective layer 200 on the inner surface 120 of the outer shell 102, the outside appearance of the outer shell 102 can remain unchanged relative to conventional safety helmets. For example, the outside of the outer shell 102 can be made in any desired color and/or with any desired graphics or logos applied thereon.

In some non-limiting embodiments or aspects, the infrared reflective layer 200 may contain material that is reflective to IR. For example, the infrared reflective layer 200 may include pure metals, such as aluminum, gold, silver, or copper. In other non-limiting embodiments or aspects, the infrared reflective layer 200 may include alloys of aluminum, gold, silver, copper, or any combination thereof. In some non-limiting embodiments or aspects, the infrared reflective layer 200 may contain at least 95 weight % of aluminum. In further non-limiting embodiments or aspects, the infrared reflective layer 200 may be made from one or more of the following materials: doped titanium dioxide, doped or undoped indium tin oxide, doped cerium oxide, doped manganese oxide, iron (III) oxide, cadmium sulfide, chromium trioxide, or any combination thereof. A thickness of the infrared reflective layer 200 may be approximately 20 nm to 5 μm, such as 30 nm.

In some non-limiting embodiments or aspects, the infrared reflective layer 200 may be a coating that is sprayed on at least a portion of the inner surface 120 of the outer shell 102. For example, the infrared reflective layer 200 may be applied to the inner surface 120 of the outer shell 102 as an atomized spray of aerosolized droplets of metallized paint or ink. Techniques for applying the paint or ink include spraying, ink jet, or pad printing. In further non-limiting embodiments or aspects, the coating may be applied by a physical vapor deposition (PVD) or a chemical vapor deposition (CVD) process using an infrared reflective material that is applied directly to the inner surface 120 of the outer shell 102. In further non-limiting embodiments or aspects, the infrared reflective layer 200 may be an infrared reflective film that is applied to at least a portion of the inner surface 120 of the outer shell 102.

In some non-limiting embodiments or aspects, the infrared reflective layer 200 may be formed on an insert 202 (see FIG. 3C) that is formed separately from the outer shell 102. The insert 202 can be removably or non-removably connected to the outer shell 102. For example, the infrared reflective layer 200 may be formed on a substrate 204 that is co-molded with the outer shell 102 during manufacture of the outer shell 102. In this manner, the insert 202 having the infrared reflective layer 200 is integrally formed with the inner surface 120 of the outer shell 102. In some non-limiting embodiments or aspects, the infrared reflective layer 200 may be formed on the substrate 204 that is configured to be thermoformed with the outer shell 102 (see FIG. 3C). The substrate 204 may be a high density polyethylene (HDPE), polyethylene terephthalate (PET), or other thermoplastic film. The infrared reflective layer 200 may be vapor deposited to the substrate 204 (using CVD or PVD) prior to joining the substrate 204 to the inner surface 120 of the outer shell 102.

During injection molding of the outer shell 102, the insert 202 may be placed over a core and the outer shell 102 can be injection molded/formed over the insert 202. Techniques for molding the insert 202 with the outer shell 102 include overmolding, insert molding, and co-molding. In this manner, the insert 202 having the infrared reflective layer 200 is formed integrally with the inner surface 120 of the outer shell 102 without the need for adhering or clipping the insert to the outer shell 102. In some embodiments or aspects, the insert 202 having the infrared reflective layer 200 may be secured to the inner surface 120 of the outer shell 120 using adhesive, ultrasonic bonding, one or more mechanical clips or fasteners, or via press fit. The insert 202 may be removably or non-removably secured to the inner surface 120 of the outer shell 120.

In some non-limiting embodiments or aspects, the infrared reflective layer 200 may have infrared reflectivity (i.e., effectiveness in reflecting radiant infrared energy) higher than 40% in the region of 700-1.400 nm. In some non-limiting embodiment or aspects, the infrared reflectivity of the infrared reflective layer 200 may be 83%-89%. Furthermore, the infrared reflective layer 200 may have hemispherical emissivity value lower than 0.2. Hemispherical emissivity relates to a material's effectiveness in emitting energy as thermal radiation. In some non-limiting embodiments or aspects, the emissivity value may be 0.06. In some non-limiting embodiments or aspects, the infrared reflective layer 200 may have optical density (i.e., a measure of radiant energy absorbance) of at least 2.0, such as 3.5.

Figure 4:
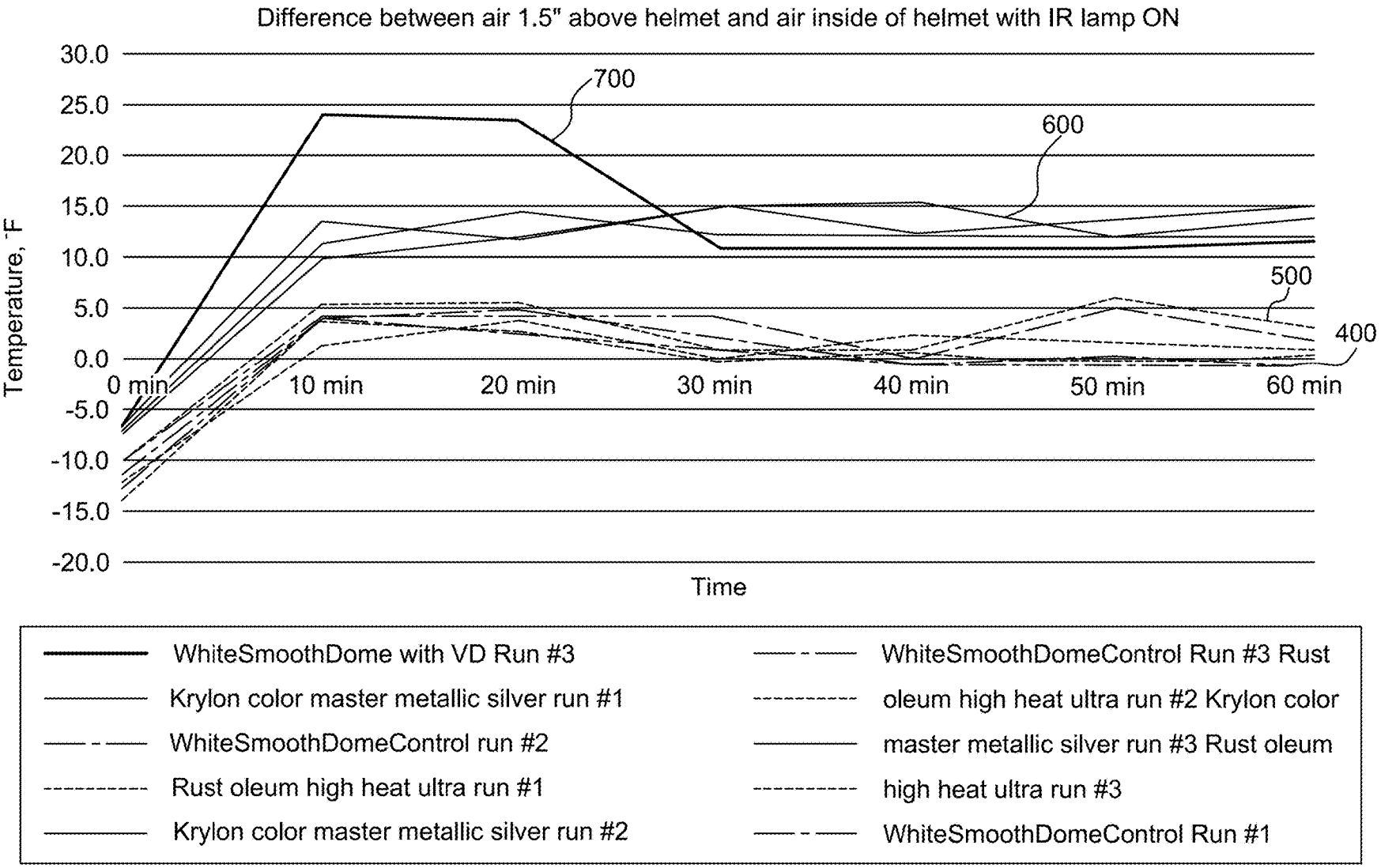
FIG. 4 is a graph showing experimental results for thermal performance of a plurality of helmets as a function of time.

With reference to FIG. 4, a graph shows experimental results of a temperature difference between an outside of a safety helmet and an inside of the safety helmet as a function of time. The graph illustrates experimental results for a control helmet that does not have an infrared reflective layer 200 (line 400) and three other helmets having various infrared reflective layers 200. FIG. 4 shows test results for a first helmet (line 500) wherein the inner surface of the helmet was coated with Rust-Oleum High Heat Ultra paint and the helmet was placed under an IR lamp for 60 minutes. Results for three separate experiments using this helmet show that there is no appreciable difference in temperature compared to the control helmet. FIG. 4 shows also test results for a second helmet (line 600) wherein the inner surface of the helmet was coated with Krylon Color Master Metallic Silver paint and the helmet was placed under an IR lamp for 60 minutes. Results for three separate experiments using this helmet show a 10-15 OF difference in temperature compared to the control helmet. FIG. 4 shows also test results for a third helmet (line 700) wherein the inner surface has an infrared reflective layer that was deposited using a chemical vapor deposition technique and the helmet was placed under an IR lamp for 60 minutes. Results for a single experiment using this helmet show a significant difference in temperature compared to the control helmet.

Figure 5:
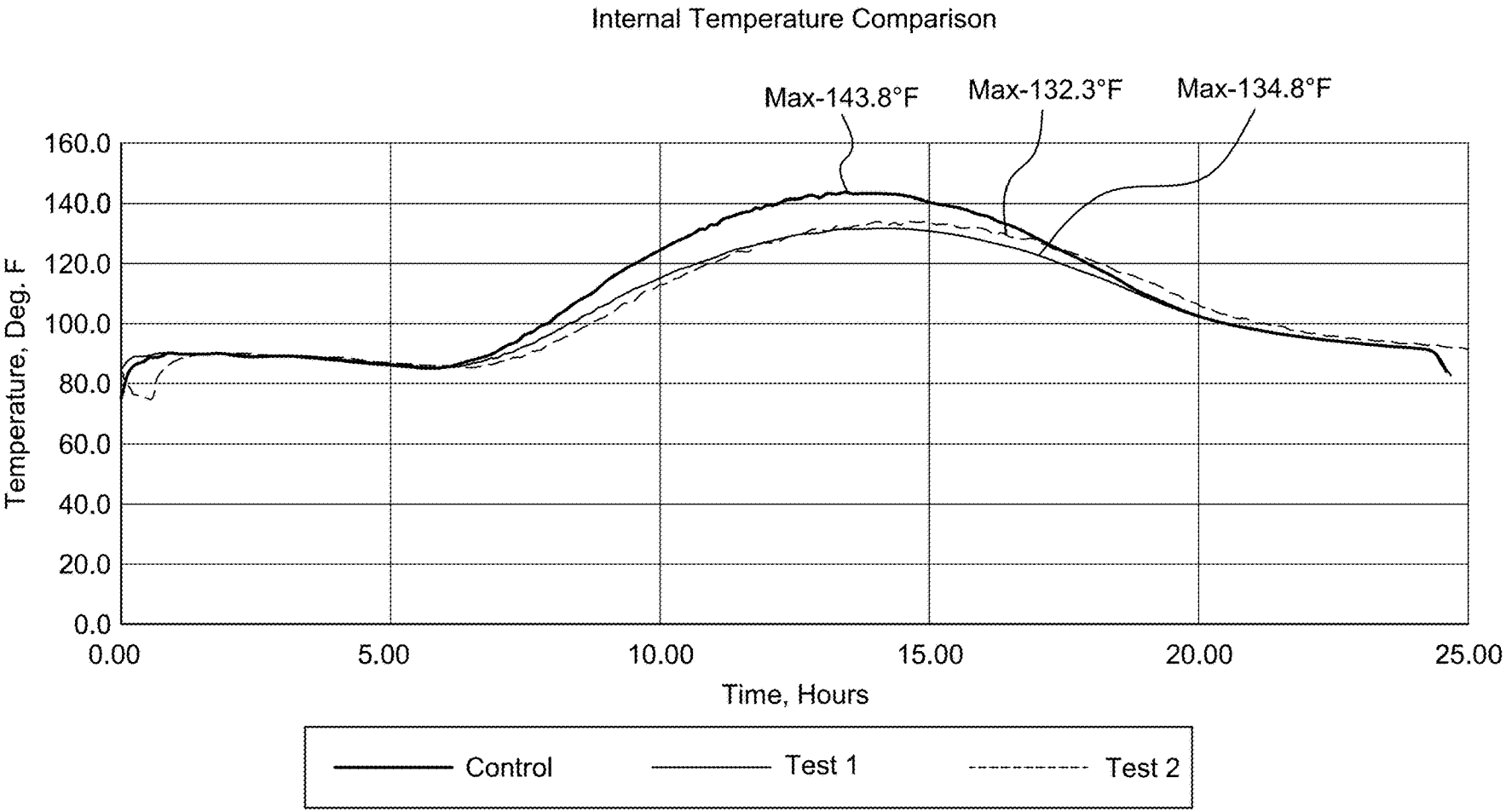
FIG. 5 is a graph showing experimental results for thermal performance of a plurality of helmets as a function of time.

With reference to FIG. 5, a graph shows experimental test results for evaluation of a pair of safety helmets 100 having different infrared reflective layers 200 against a control safety helmet 100 without the infrared reflective layer 200. The experimental test was performed in accordance with the solar radiation testing guidelines set forth in Method 505, Procedure I of MIL-STD-810G. The control safety helmet 100, which was a black, non-vented helmet, achieved a maximum internal temperature of 143.8° F. The first safety helmet 100 with the infrared reflective layer 200 in the form of a metallizing PVD coating, achieved a maximum internal temperature of 132.3° F. The second safety helmet 100 with the infrared reflective layer 200 in the form of an overmolded thermoformed insert, achieved a maximum internal temperature of 134.8° F.

Figure 6A:
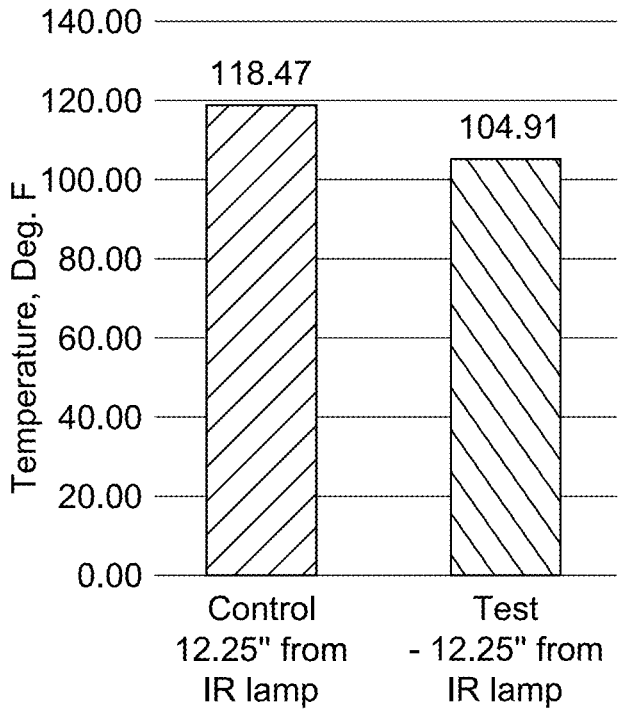
FIG. 6A is a graph showing experimental results for thermal performance of a control helmet and a safety helmet in accordance with some non-limiting embodiments or aspects of the present disclosure, with the graph showing the results of a first thermal test.
Figure 6B:
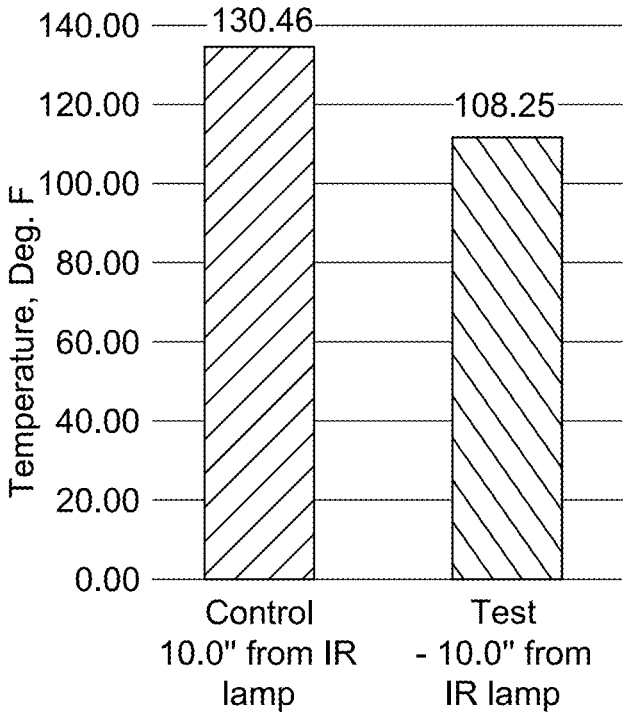
FIG. 6B is a graph showing experimental results for thermal performance of a control helmet and a safety helmet in accordance with some non-limiting embodiments or aspects of the present disclosure, with the graph showing the results of a second thermal test.

FIGS. 6A-6B show the difference between a safety helmet with the infrared reflective layer 200 and without the infrared reflective layer 200 using a single IR lamp. FIG. 6 shows the results between a control helmet (without the infrared reflective layer 200) and a test helmet (with the infrared reflective layer 200) from an evaluation at a distance sufficient to achieve an approximate solar irradiance of 600 $W/m^2$. FIG. 6B shows the results from an evaluation between a control helmet (without the infrared reflective layer 200) and a test helmet (with the infrared reflective layer 200) at a distance sufficient to achieve an approximate solar irradiance value of 1,000 $W/m^2$. The temperature shown on the Y-axis of the graphs in FIGS. 6A-6B represents the maximum recorded internal shell temperature.

Figure 2:
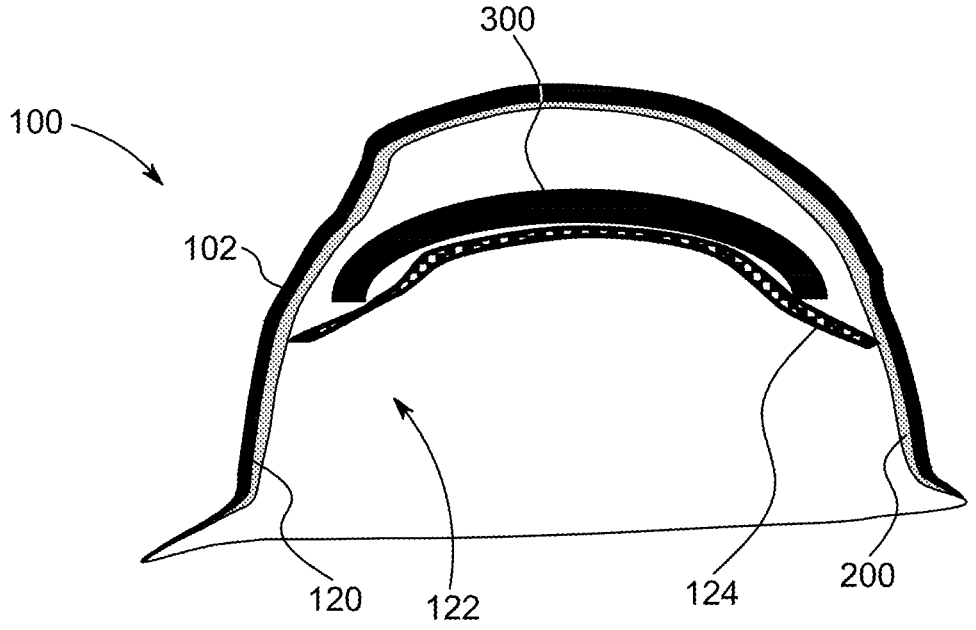
FIG. 2 is a side cross-sectional view of the safety helmet of FIG. 1.

With reference to FIG. 2, the safety helmet 100 may have an evaporative cooling pad 300 positioned within an interior cavity 122 defined by the inner surface 120 of the outer shell 102. In some non-limiting embodiments or aspects, the cooling pad 300 may be removably or non-removably connected to at least a portion of a suspension arrangement 124 connected to the inner surface 120 of the outer shell 102. In some non-limiting embodiments or aspects, the cooling pad 300 may be removably connected to the suspension arrangement 124 via hook and loop fasteners, buttons, clasps, hooks, or other connection mechanisms. The evaporative cooling pad 300 may be configured for cooling the user's head via a water evaporation process, as described herein.

Figure 8:
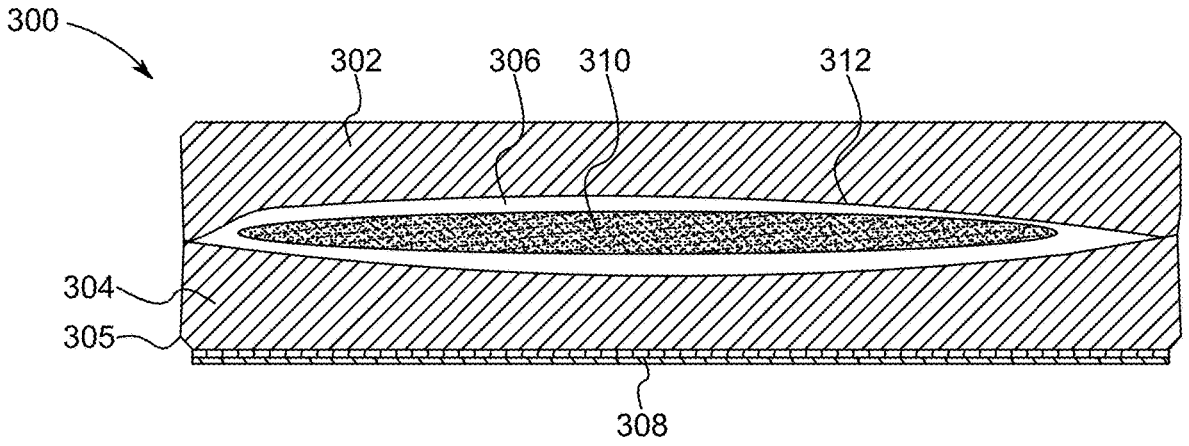
FIG. 8 is a cross-sectional view of the evaporative cooling pad shown in FIG. 3.

With reference to FIG. 8, the evaporative cooling pad 300 has a top layer 302, a bottom layer 304, and a cavity 306 defined therebetween. An outside surface 305 of the bottom layer 304 is configured to be in contact with the head of the user, as described herein. The top layer 302 and the bottom layer 304 may be made from waterproof, vapor permeable materials that are sewn together or otherwise connected together to define the cavity 306 therebetween. In some non-limiting embodiments or aspects, the top layer 302 and the bottom layer 304 may be made from a nylon material that is laminated with a waterproof and vapor permeable material. In some non-limiting embodiments or aspects, the top layer 302 and the bottom layer 304 may be made from polyurethane or polytetrafluoroethylene. In some non-limiting embodiments or aspects, the top layer 302 and the bottom layer 304 may have sweat absorbing fabric 308 on an outside surface thereof.

With reference to FIG. 8, the evaporative cooling pad 300 further has a liquid absorbing layer 310 positioned within the cavity 306, and an opening 312 provided in at least one of the top and bottom layers 302, 304. In some non-limiting embodiments or aspects, the opening 312 may be provided in a seam between the top and bottom layers 302, 304. In some non-limiting embodiments or aspects, the opening 312 may have a zipper or other closure mechanism for enclosing the opening. The opening 312 may be configured for allowing a cooling liquid, such as water, to be added to the cavity 306 such that the liquid saturates the liquid absorbing layer 310. The top layer 302 and the bottom layer 304 are configured to allow passage of the cooling liquid in a direction out of the cavity 306 in vapor form but not allow passage of the cooling liquid in liquid form.

Figure 7:
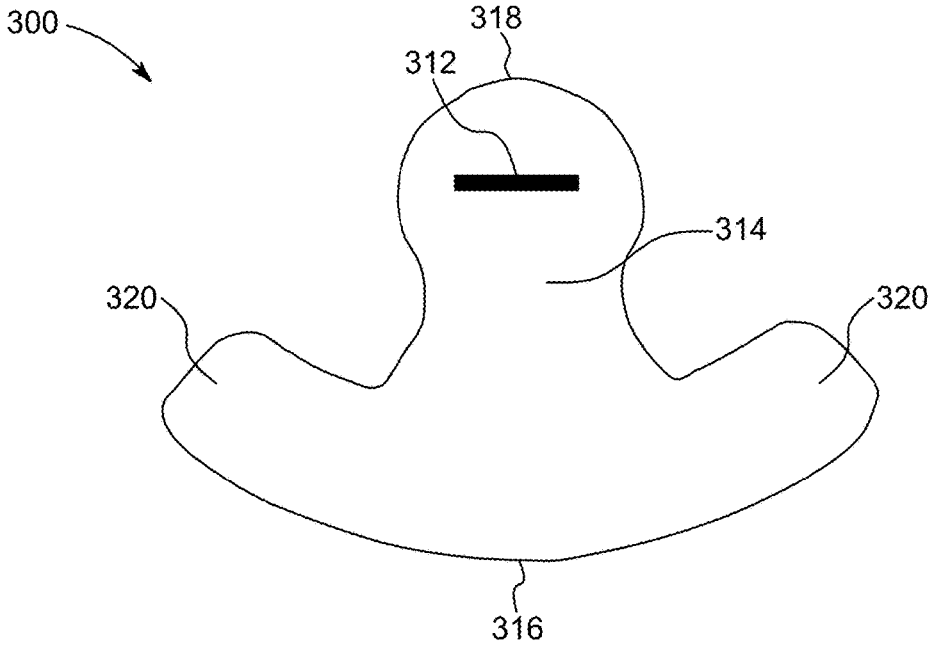
FIG. 7 is a top view of an evaporative cooling pad configured for use with a safety helmet, with an evaporative cooling pad shown in accordance with some non-limiting embodiments or aspects of the present disclosure.

With reference to FIG. 7, the evaporative cooling pad 300 may be substantially T-shaped. For example, the evaporative cooling pad 300 may have a main portion 314 having a first end 316 opposite a second end 318. A pair of wings 320 extend laterally from the first end 316. In some non-limiting embodiments or aspects, the first end 316, the second end 318, and/or the wings 320 may have a rounded shape. In use, the first end 316 is configured to be in contact with a forehead of the user, each of the pair of wings 320 is configured to extend to a temple of the user, and the second end 318 is configured to extend to a top of the head of the user.

The evaporative cooling pad 300 is configured to allow heat to be transferred from the head of the user to the evaporative cooling pad 300, thereby evaporating the liquid in the cavity 306. Evaporating the liquid provides the cooling feeling as it removes the heat from the head. By combining the infrared reflective layer 200 with the evaporative cooling pad 300 in the same helmet 100, the infrared reflective layer 200 is able to enhance the efficiency of the evaporative cooling pad 300. With a cooler ambient air in the helmet 100 from the infrared reflective material, less cooling liquid will be evaporated due to the ambient air temperature and infrared radiation. Instead, the liquid will evaporate due to removing heat from the head of the user.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments of the disclosure is intended to be illustrative, but not limiting, of the scope of the disclosure, which is set forth in the following claims.

Although the disclosure has been described in detail for the purpose of illustration based on what are currently considered to be the most practical and preferred embodiments or aspects, it is to be understood that such detail is solely for that purpose and that the disclosure is not limited to the disclosed embodiments or aspects, but, on the contrary, is intended to cover modifications and equivalent arrangements that are within the spirit and scope of the appended claims. For example, it is to be understood that the present disclosure contemplates that, to the extent possible, one or more features of any embodiment or aspect can be combined with one or more features of any other embodiment or aspect.

What is claimed is:

1. A safety helmet comprising:

an outer shell configured for surrounding a head of a user, the outer shell comprising a rigid thermoplastic material that is permeable to infrared radiation from an exterior of the helmet; and an infrared reflective layer, comprising aluminum, gold, silver or copper having a purity of at least 95%, disposed on substantially the entirety of an interior of the outer shell, the infrared reflective layer comprising a metallization layer which is directly deposited to an inner surface of the outer shell and is configured for reflecting at a least a portion of incident infrared radiation transmitted through the outer shell; and wherein the at least 95% pure infrared reflective layer has infrared reflectivity of at least 83%, a hemispherical emissivity of less than 0.2 to prevent the at least a portion of incident infrared radiation from permeating the reflective layer to the interior of the helmet, and a thickness of the infrared reflective layer is 20 nm to 5 μm.

2. The safety helmet of claim 1, wherein the infrared reflective layer has an optical density of at least 2.0.

3. The safety helmet of claim 1, wherein the infrared reflective layer comprises at least one of the following: doped titanium dioxide, doped or undoped indium tin oxide, doped cerium oxide, doped manganese oxide, iron (III) oxide, cadmium sulfide, chromium trioxide, or any combination thereof.

4. The safety helmet of claim 1, wherein the metallization layer is deposited by a physical vapor deposition (PVD) process.

5. The safety helmet of claim 1, wherein metallization layer is deposited on the inner surface of the outer shell by a chemical vapor deposition (CVD) process.

6. The safety helmet of claim 1, further comprising:

an evaporative cooling pad having wings extending therefrom which are configured to extend to a temple of the user.

7. The safety helmet of claim 1, wherein the metallization layer is deposited using an atomized spray of aerosolized droplets of metallized paint or ink.

8. The safety helmet of claim 1, wherein the metallization layer is deposited by a painting process.

9. The safety helmet of claim 1, wherein the outer shell comprises a rigid thermoplastic material.

10. The safety helmet of claim 1, wherein the safety helmet further comprises an evaporative cooling pad having a t-shape, wings extending from a first end which are configured to extend to a temple of the user and a second end which is configured to extend to a top of a head of the user.

11. A safety helmet comprising:

an outer shell configured for surrounding a head of a user, the outer shell comprising a rigid thermoplastic material that is permeable to infrared radiation from an exterior of the helmet;

an infrared reflective layer, comprising aluminum, gold, silver, or copper having a purity of at least 95%, on substantially the entirety of an inner surface of the outer shell, the infrared reflective layer being configured for reflecting at a least a portion of incident infrared radiation transmitted through the outer shell; and an evaporative cooling pad positioned within a cavity defined by the inner surface of the outer shell, the evaporative cooling pad comprising:

a top waterproof, vapor permeable layer and a bottom waterproof, vapor permeable layer with a cavity defined therebetween, wherein the outside surface of the bottom layer is configured to be in contact with the head of the user;

wings having a shape and size configured to extend to a temple of the user, and a liquid absorbing layer positioned within the cavity, wherein the at least 95% pure infrared reflective layer has infrared reflectivity of at least 83%, a hemispherical emissivity of less than 0.2 to prevent the at least a portion of incident infrared radiation from permeating the reflective layer to the interior of the helmet, and a thickness of the infrared reflective layer is 20 nm to 5 μm.

12. The safety helmet of claim 11, wherein the top and bottom layers comprise a nylon material laminated with a waterproof and vapor permeable material.

13. The safety helmet of claim 11, wherein at least one of the top and bottom layers comprises polyurethane or polytetrafluoroethylene.

14. The safety helmet of claim 11, wherein the evaporative cooling pad further comprises a sweat absorbing fabric on an outside surface of the bottom layer.

15. The safety helmet of claim 11, wherein the evaporative cooling pad further comprises an opening in at least one of the top and bottom layers, and wherein the opening has a zipper.

16. The safety helmet of claim 11, wherein the evaporative cooling pad comprises a main portion having a first end and a second end, and wherein the pair of wings extend laterally from the first end.

17. The safety helmet of claim 16, wherein the first end is configured to be in contact with a forehead of the user, and wherein the second end is configured to extend to a top of the head of the user.

18. The safety helmet of claim 11, wherein the outer shell comprises a rigid thermoplastic material.

19. A method of manufacturing a safety helmet comprising:

molding an outer shell of the safety helmet out of a rigid thermoplastic material that is permeable to infrared radiation from an exterior of the helmet; and applying an at least 95% pure infrared reflective layer onto at least a portion of an inner surface of the outer shell by depositing a metallization layer directly on an inner surface of the outer shell, wherein the at least 95% pure infrared reflective layer has infrared reflectivity of at least 83%, a hemispherical emissivity of less than 0.2 to prevent the at least a portion of incident infrared radiation from permeating the reflective layer to the interior of the helmet, and a thickness of the infrared reflective layer is 20 nm to 5 μm.

20. The method of claim 19, further comprising inserting an evaporative cooling pad inside a cavity of the outer shell defined by the inner surface, wherein the evaporative cooling pad comprises:

a top waterproof, vapor permeable layer and a bottom waterproof, vapor permeable layer with a cavity defined therebetween;

a liquid absorbing layer positioned within the cavity; and an opening in at least one of the top and bottom layers.

21. The method of claim 20, wherein the evaporative cooling pad has wings configured to extend to a temple of a user.

22. A safety helmet comprising:

an outer shell configured for surrounding a head of a user, the outer shell comprising a rigid thermoplastic material that is permeable to infrared radiation from an exterior of the helmet; and an infrared reflective layer, comprising aluminum, gold, silver or copper having a purity of at least 95%, disposed on substantially the entirety of an interior of the outer shell, the infrared reflective layer comprising a metallization layer which is directly deposited to an inner surface of the outer shell and is configured for reflecting at a least a portion of incident infrared radiation transmitted through the outer shell; and wherein the at least 95% pure infrared reflective layer has infrared reflectivity of at least 83%, a hemispherical emissivity of less than 0.2 to prevent the at least a portion of incident infrared radiation from permeating the reflective layer to the interior of the helmet, and an optical density of at least 2.0.

* * * * *